US008692746B2

(12) United States Patent
Ebisuno

(10) Patent No.: US 8,692,746 B2
(45) Date of Patent: Apr. 8, 2014

(54) IMAGE DISPLAY DEVICE FOR REDUCING THE AMOUNT OF TIME REQUIRED TO PERFORM PLURAL, CONSECUTIVE THRESHOLD VOLTAGE CORRECTION OPERATIONS

(75) Inventor: Kohei Ebisuno, Yamato (JP)

(73) Assignee: LG Display Co,. Ltd., Seoul (KR)

( * ) Notice: Subject to any disclaimer, the term of this patent is extended or adjusted under 35 U.S.C. 154(b) by 345 days.

(21) Appl. No.: 13/131,635

(22) PCT Filed: Nov. 30, 2009

(86) PCT No.: PCT/JP2009/070123
§ 371 (c)(1),
(2), (4) Date: Jun. 20, 2011

(87) PCT Pub. No.: WO2010/061950
PCT Pub. Date: Jun. 3, 2010

(65) Prior Publication Data

US 2011/0249044 A1 Oct. 13, 2011

(30) Foreign Application Priority Data

Nov. 28, 2008 (JP) ..... 2008-304558

(51) Int. Cl.
*G09G 3/30* (2006.01)

(52) U.S. Cl.
USPC ..... 345/77; 345/82

(58) Field of Classification Search
CPC ..... G09G 3/30; G09G 3/3208; G09G 3/3225; G09G 3/3233; G09G 3/3241; G09G 3/325; G09G 2300/043; G09G 2300/0819; G09G 2300/0852; G09G 2300/0866; G09G 2310/0251; G09G 2320/0233; G09G 2320/0252; G09G 2320/045
USPC ..... 345/76–83, 204–215, 690–699; 315/169.3–169.4; 313/463, 504
See application file for complete search history.

(56) References Cited

U.S. PATENT DOCUMENTS

2004/0145547 A1* 7/2004 Oh ..... 345/76
2004/0252089 A1 12/2004 Ono et al.

(Continued)

FOREIGN PATENT DOCUMENTS

JP 2004-341359 A1 12/2004
JP 2005-99715 A 4/2005

(Continued)

*Primary Examiner* — Chanh Nguyen
*Assistant Examiner* — Navin Lingaraju
(74) *Attorney, Agent, or Firm* — Birch, Stewart, Kolasch & Birch, LLP

(57) ABSTRACT

According to one embodiment, an image display device includes a display panel including a pixel circuit, the pixel circuit including a light-emitting element, a driver element, and a capacitor element. The image display device further includes a charge supply line for supplying electrical charge to the light-emitting element of the pixel circuit; and a drive control unit which supplies second electrical charge from the charge supply line to the light-emitting element after first electrical charge accumulated in the light-emitting element is supplied to the capacitor element, further supplies the second electrical charge to the capacitor element and accumulates the first charge and the second charge in the capacitor element, and applies a voltage greater than or equal to the threshold voltage to a control terminal of the driver element, within one frame after the light-emitting element emits light until the light-emitting element emits light next.

5 Claims, 9 Drawing Sheets

(56) References Cited

U.S. PATENT DOCUMENTS

| | | | | |
|---|---|---|---|---|
| 2005/0052377 | A1* | 3/2005 | Hsueh | 345/82 |
| 2005/0083270 | A1 | 4/2005 | Miyazawa | |
| 2005/0200575 | A1* | 9/2005 | Kim et al. | 345/76 |
| 2005/0285825 | A1* | 12/2005 | Eom et al. | 345/76 |
| 2006/0043375 | A1* | 3/2006 | Takasugi et al. | 257/72 |
| 2006/0139253 | A1* | 6/2006 | Choi et al. | 345/76 |
| 2006/0156121 | A1* | 7/2006 | Chung | 714/726 |
| 2006/0267884 | A1 | 11/2006 | Takahashi et al. | |
| 2008/0088546 | A1* | 4/2008 | Takasugi et al. | 345/76 |
| 2008/0111774 | A1* | 5/2008 | Iida et al. | 345/76 |
| 2008/0180422 | A1* | 7/2008 | Kusafuka et al. | 345/204 |
| 2008/0198103 | A1* | 8/2008 | Toyomura et al. | 345/77 |
| 2008/0246747 | A1 | 10/2008 | Taneda et al. | |
| 2009/0284511 | A1* | 11/2009 | Takasugi et al. | 345/211 |
| 2009/0303260 | A1* | 12/2009 | Takasugi | 345/690 |

FOREIGN PATENT DOCUMENTS

| | | | |
|---|---|---|---|
| JP | 2005-258326 | A | 9/2005 |
| JP | 2006-330223 | A | 12/2006 |
| JP | 2008-185874 | A | 8/2008 |
| JP | 2008-257085 | A | 10/2008 |
| WO | WO 2007/040088 | A1 | 4/2007 |

* cited by examiner

IMAGE DISPLAY DEVICE FOR REDUCING THE AMOUNT OF TIME REQUIRED TO PERFORM PLURAL, CONSECUTIVE THRESHOLD VOLTAGE CORRECTION OPERATIONS

CROSS REFERENCE TO RELATED APPLICATIONS

This application is the National Phase application of International Application No. PCT/JP2009/070123, filed on Nov. 30, 2009 which designates the United States, and which claims the benefit of priority from Japanese Patent Application No. 2008-304558, filed on Nov. 28, 2008. The entire contents of all of the above applications are hereby incorporated by reference into the present application.

TECHNICAL FIELD

The present invention relates to an image display device such as an organic EL display (electro luminescence) device.

BACKGROUND ART

Conventionally, an image display device, which uses an organic EL (Electro Luminescence) element emitting light when holes and electrons injected into a light-emitting layer is recombined, is proposed.

In this type of the image display device, a thin film transistor (hereinafter, called "TFT") formed of, for example, amorphous silicon, polycrystalline silicon, or the like, and an organic light-emitting diode (hereinafter, called "OLED") or the like which is one of organic EL elements configure respective pixels. There is also known an image display device employing an active matrix system in which the brightness of respective pixels is controlled by setting appropriate current values to the respective pixels (refer to, for example, Japanese Patent Application Laid-open No. 2005-099715). Note that a threshold voltage at which a current starts to flow through TFT is different in each TFT.

Incidentally, in order to correct variations of threshold voltages $V_{th}$ of TFTs employing the active matrix system, the threshold voltages $V_{th}$ are detected by causing a gate and a drain of a target TFT to be conductive to each other to gradually discharge electrical charge accumulated in the gate of the TFT and to cause a gate potential to converge to the threshold voltage $V_{th}$.

However, to detect the threshold voltages $V_{th}$, it is necessary to first apply initial potential ($V_{th}$ detection start potential) so that a gate-drain potential of the target TFT becomes greater than the threshold voltage $V_{th}$. If this initial potential is lower than the threshold voltage $V_{th}$, the threshold voltage $V_{th}$ cannot be properly detected and an operation error is caused thereby.

SUMMARY OF THE INVENTION

An object of the present invention is to provide an image display device capable of stably applying a voltage greater than a threshold voltage $V_{th}$ to a driver element for a long time.

In order to achieve the aforementioned object, an image display device according to an aspect of the present invention includes a display panel including a pixel circuit, the pixel circuit including a light-emitting element, a driver element, and a capacitor element, the light-emitting element emitting light when a voltage is applied thereto in a forward direction and accumulating electrical charge when a voltage is applied thereto in a reverse direction, the driver element causing the light-emitting element to emit the light when a voltage equal to or greater than a threshold voltage is applied thereto, the capacitor element accumulating electrical charge for adjusting current flowing in the driver element. The image display apparatus further includes: a charge supply line for supplying electrical charge to the light-emitting element of the pixel circuit; and a drive control unit which supplies second electrical charge from the charge supply line to the light-emitting element after first electrical charge accumulated in the light-emitting element is supplied to the capacitor element, further supplies the second electrical charge to the capacitor element and accumulates the first charge and the second charge in the capacitor element, and applies a voltage greater than or equal to the threshold voltage to a control terminal of the driver element, within one frame after the light-emitting element emits light until the light-emitting element emits light next.

Image display devices according to embodiments of the present invention achieve an effect that a voltage greater than or equal to the threshold voltage $V_{th}$ can be stably applied to a driver element for a long time.

BEST MODE(S) FOR CARRYING OUT THE INVENTION

An image display device according to an embodiment of the present invention will be explained below in detail based on the drawings.

First, terms and the like used in the following embodiments will be explained.

The wording "electrically connected" is used in a meaning including both of a mode in which one member is conductively connected to the other member via a wiring and the like at all times and a mode in which one member is indirectly connected to the other member not only by a conductive wiring and the like but also by other members. That is, the wording "electrically connected" is used in a meaning including a mode in which one member is conductively connected to the other member by a wiring and other members in response to a state of the other member (for example, in response to a conductive state in which a current can flow between a source and a drain of a transistor).

Further, the "threshold voltage" means a gate-source voltage which acts as a boundary when a transistor shifts from an off-state (a state in which a drain current does not flow) to an on-state (a state in which a drain current flows).

Figure 1:
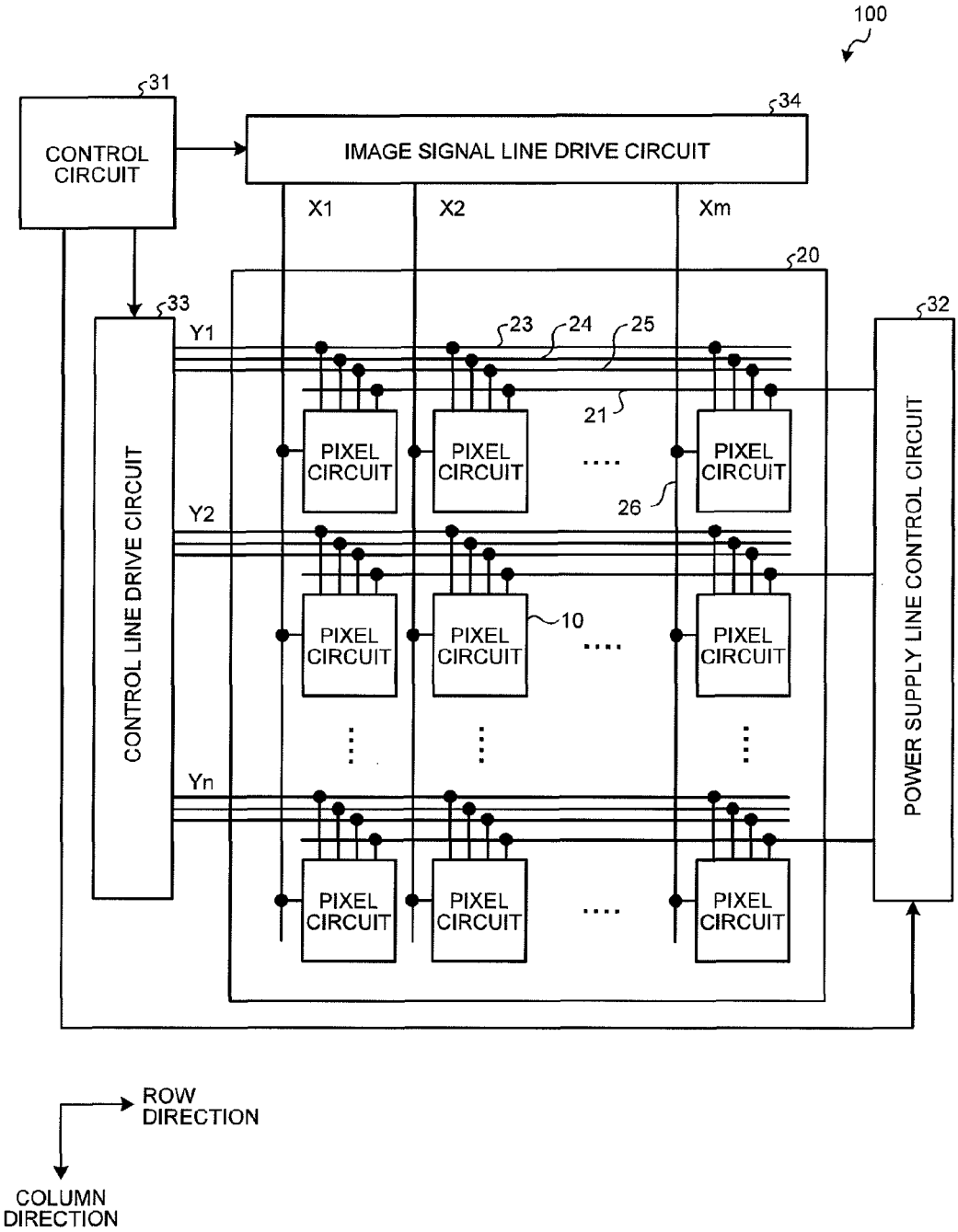
FIG. 1 is a view schematically illustrating a configuration of an image display device according to a first embodiment of the present invention.

A first embodiment will be explained first. FIG. 1 is a view schematically illustrating a configuration of an image display device 100 according to the first embodiment. As illustrated in the view, the image display device 100 includes a display panel 20 in which pixel circuits 10 to be described later are disposed in a matrix (two-dimensionally), a control circuit 31, a power supply control circuit 32, a control line drive circuit 33, and an image signal line drive circuit 34. Note that FIG. 1 shows an example in which the pixel circuits 10 of m columns×n rows are disposed in the matrix state.

The display panel 20 is disposed with a $V_{SS}$ line 21 as a charge supply line, a $T_{th}$ control line 23, a merge line 24, and a scan line 25, in a horizontal direction of a screen (in the row direction in the figure). Further, the display panel 20 is disposed with an image signal line 26 in a vertical direction of the screen (in a column direction of the figure). Here, the $V_{SS}$ line 21 is electrically connected to the power supply control circuit 32, and the $T_{th}$ control line 23, the merge line 24, and the scan line 25 are electrically connected to the control line drive circuit 33. Further, the image signal line 26 is electrically connected to the image signal line drive circuit 34. Note that it is assumed that a GND line 22 acting as a ground of the display panel 20 (see FIG. 2) is connected to each of the pixel circuits 10.

The control circuit 31 can be configured using, for example, a control device such as a drive IC, a counter, and/or the like including an arithmetic operation circuit, a logic circuit, and/or the like therein. Then, the control circuit 31 controls the power supply control circuit 32, the control line drive circuit 33, and the image signal line drive circuit 34.

The power supply control circuit 32 can be configured using, for example, an IC and/or the like including a switching element and/or the like therein. The power supply control circuit 32 controls a timing at which a power (potential) created therein is applied to the $V_{SS}$ line 21 based on a clock signal input from the control circuit 31.

The control line drive circuit 33 can be configured using, for example, an IC and the like including a switching element and the like therein. The control line drive circuit 33 controls a timing, at which various types of control signals created therein are applied to the $T_{th}$ control line 23, the merge line 24, and the scan line 25 based on the clock signal input from the control circuit 31.

The image signal line drive circuit 34 can be configured using, for example, an IC and the like including an arithmetic operation circuit and the like therein. The image signal line drive circuit 34 generates a voltage corresponding to an image signal input from the control circuit 31 (hereinafter, referred to as an image signal voltage) based on the image signal and also controls a timing at which the generated image signal voltage is supplied to the image signal line 26 based on the clock signal input from the control circuit 31.

Note that, in the configuration of FIG. 1, layouts as to the $V_{SS}$ line 21, the $T_{th}$ control line 23, the merge line 24, the scan line 25, and the image signal line 26 as well as the control circuit 31, the power supply control circuit 32, the control line drive circuit 33, and the image signal line drive circuit 34 illustrates merely an example and the layout is not limited thereto. For example, in FIG. 1, although the control circuit 31, the power supply control circuit 32, the control line drive circuit 33, and the image signal line drive circuit 34 are disposed outside of the display panel 20, some or all of the circuits may be disposed inside of the display panel 20.

Figure 2:
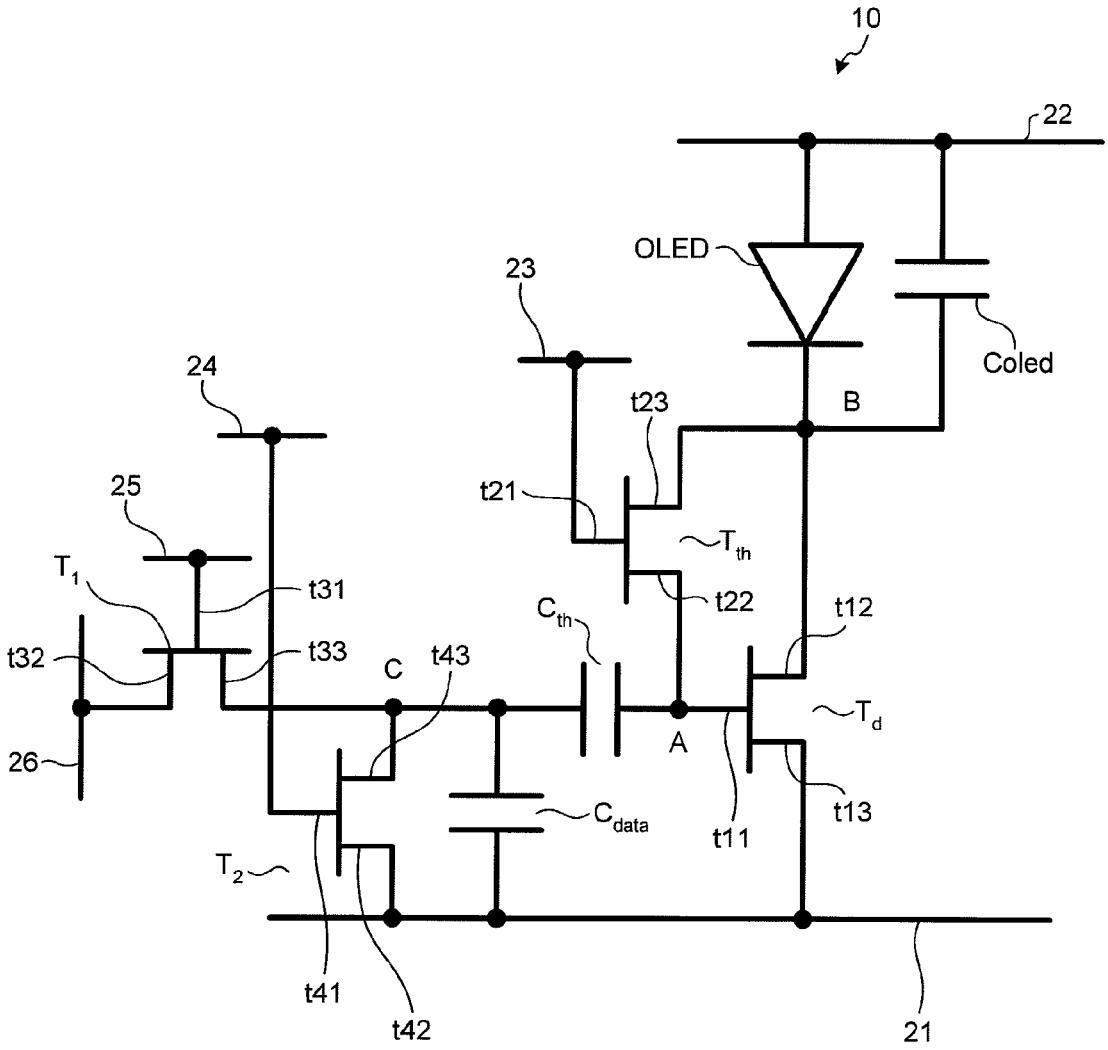
FIG. 2 is a view illustrating an example of a configuration of a pixel circuit (one pixel).

Here, a configuration of the pixel circuit will be explained. FIG. 2 is a view illustrating an example of a configuration of the pixel circuit 10 (one pixel) illustrated in FIG. 1. As illustrated in the view, the pixel circuit 10 includes: an organic EL element OLED as a light-emitting element; a drive transistor $T_d$ as a driver element for deriving the organic EL element OLED; a threshold voltage detecting transistor $T_{th}$ as a threshold voltage detecting element used when a threshold voltage of the drive transistor $T_d$ is detected; a first capacitor element $C_{th}$ as a capacitor element for holding a threshold voltage; a second capacitor element $C_{data}$ for holding an image signal voltage; a switching transistor $T_1$; and a switching transistor $T_2$. Note that since the organic EL element OLED functions as a capacitor when an inverted voltage is applied thereto, FIG. 2 equivalently indicates the organic EL element OLED as an organic EL element capacitor $C_{oled}$.

The drive transistor $T_d$, the threshold voltage detecting transistor $T_{th}$, the switching transistor $T_1$, and the switching transistor $T_2$ are, for example, thin film transistors (hereinafter, referred to "TFT"). Note that, in the respective drawings referred to below, although the type (a n-type or a p-type) of channels of the respective thin film transistors is not particularly clarified, the type is either the n-type or the p-type, and it is assumed that an n-type TFT is used in the embodiment.

The drive transistor $T_d$ includes a control terminal t11, a first terminal t12, and a second terminal t13. The control terminal t11 is electrically connected to an electrode of the first capacitor element $C_{th}$. Further, the first terminal t12 is electrically connected to an anode electrode of the organic EL element OLED, and the second terminal t13 is electrically connected to the $V_{SS}$ line 21. Here, the control terminal t11 corresponds to a gate electrode (gate). Further, one of the first terminal t12 and the second terminal t13 corresponds to a drain electrode (drain), and the other one of the first terminal t12 and the second terminal t13 corresponds to a source electrode (source). Note that the relative potential relation between the first terminal t12 and the second terminal t13 varies depending on respective control periods to be described later. Further, "drain" and "source" are defined by the conductive type and the relative potential relation of the transistor.

In an n-type transistor used in the embodiment, a high potential side terminal becomes "drain" and a low potential side terminal becomes "source" among the two terminals (i.e., the first terminal t12 and the second terminal t13) disposed across a channel region. Further, in a p-type transistor, a low potential side terminal becomes "drain" and a high potential side terminal becomes "source" among the two terminals disposed across a channel region.

In the drive transistor $T_d$, the current that flows between a drain and a source is adjusted by adjusting a potential applied to the control terminal t11, and more specifically, by adjusting a voltage (gate-source voltage) applied to a gate with respect to a source. Then, a state (on-state) in which a current can flow between the drain and the source and a state (off-state) in which a current cannot flow between them are selectively set according to the potential applied to the control terminal t11.

The threshold voltage detecting transistor $T_{th}$ has a function for electrically connecting the gate electrode (gate) and the drain electrode (drain) of the drive transistor $T_d$ when the threshold voltage detecting transistor $T_{th}$ is turned on. When the threshold voltage detecting transistor $T_{th}$ is in the on-state, a current flows from the gate electrode to the drain electrode of the drive transistor $T_d$, and when the current does not substantially flows, a potential difference between the gate electrode and the source electrode of the drive transistor $T_d$ becomes the actual threshold voltage $V_{th}$.

In the organic EL element OLED, when a potential difference greater than or equal to a conduction voltage of the organic EL element OLED is generated between an anode electrode as one end thereof and a cathode electrode as the other end thereof, current flows through a light-emitting layer between the anode electrode and the cathode electrode and the light-emitting layer emits light. Specifically, for the anode electrode, metal such as aluminum, silver, copper or gold, alloys of such metals, and/or the like can be used. Further, for the cathode electrode, a conductive material having a light transmission property such as an indium tin oxide film (ITO), a material such as magnesium, silver, aluminum or calcium, and/or the like can be used. Note that the light-emitting layer emits light when holes and electrons injected into the light-emitting layer are recombined.

The embodiment has such a structure that the anode electrode, the light-emitting layer, and further the cathode electrode are formed on the pixel circuit in this order.

The light-emitting layer is composed of a material having a light-emitting property such as Alq3 (tris(8-quinolinolato) aluminum complex). To increase a light-emitting efficiency, the light-emitting layer may be configured by doping an organic metal compound such as tris[pyridinyl-kN-phenyl-kC]iridium or pigment such as coumarin as a dopant material to a host material having a hole transport property or an electron transport property. The concentration of the dopant material that configures the light-emitting layer is set to, for example, 0.5 mass % or more to 20 mass % or less. Examples of the host material having the hole transport property include α-NPD, TPD, and the like. Examples of the host material having the electron transport property include bis(2-methyl-8-quinolinolato)-4-(phenylphenolato)aluminum, 1,4-phenylene bis(triphenylsilane), 1,3-bis(triphenylsilyl)benzene, 1,3,5-tri(9H-carbazole-9-yl)benzene, CBP, Alq3 or SDPVBi, and the like. Note that an appropriate material is selected according to the color of emitted light as a material that configures respective layers of the light-emitting layer. Examples of a dopant material for emitting red light include tris(1-phenyl isothiocyanate-C2,N)iridium or DCJTB, and the like. Examples of a dopant material for emitting green light include tris[pyridinyl-kN-phenyl-kC]iridium or bis[2-(2-benzoxazole)phenolato] zinc(II) and the like. Available as a dopant material for emitting blue light are distyryl arylene derivatives, perylene derivatives or an azomethine zinc complexes and the like. The light-emitting layer is not limited to one layer structure and may be a plural-layer structure.

The anode electrode of the organic EL element OLED is electrically connected to the first terminal t12 of the drive transistor $T_d$, and the cathode electrode thereof is electrically connected to the GND line 22. Note that, in the pixel circuit 10 used in the embodiment, the anode electrode of the organic EL element OLED is configured as a common anode type which is common to all the pixels that configure the image display device.

The threshold voltage detecting transistor $T_{th}$ includes a first terminal t21, a second terminal t22, and a third terminal t23. The first terminal t21 is electrically connected to the $T_{th}$ control line 23. The second terminal t22 is conductively connected to a wiring that electrically connects the control terminal t11 of the drive transistor $T_d$ and the electrode of the first capacitor element $C_{th}$. Further, the third terminal t23 is conductively connected to a wiring that electrically connects the first terminal t12 of the drive transistor $T_d$ and the cathode electrode of the organic EL element OLED. Here, the first terminal t21 corresponds to a gate electrode. Further, one of the second terminal t22 and the third terminal t23 corresponds to a source electrode, and other one of them corresponds to a drain electrode, respectively. Note that the relative potential relation between the second terminal t22 and the third terminal t23 varies depending on the respective control periods to be described later as in the drive transistor $T_d$.

In the threshold voltage detecting transistor $T_{th}$, the current that flows between a drain and a source is adjusted by adjusting a potential applied to the first terminal t21, and more specifically, by adjusting a voltage (gate-source voltage) applied to a gate with respect to a source. Then, a state (on-state) in which a current can flow between the drain and the source and a state (off-state) in which the current cannot flow between them are selectively set according to the potential applied to the first terminal t21.

Further, the threshold voltage detecting transistor $T_{th}$ can electrically connect the gate and the drain of the drive transistor $T_d$ when the threshold voltage detecting transistor $T_{th}$ is turned on. Then, a current flows from the gate of the drive transistor $T_d$ to the drain thereof until the gate-source voltage of the drive transistor $T_d$ becomes the threshold voltage $V_{th}$ of the drive transistor $T_d$. As a result, the threshold voltage $V_{th}$ of the drive transistor $T_d$ is detected.

That is, the threshold voltage detecting transistor $T_{th}$ is provided to realize a $V_{th}$ compensation function for compensating variations of the threshold voltages $V_{th}$ in the drive transistor $T_d$ by setting the gate-source voltage of the drive transistor $T_d$ for each pixel based on the threshold voltage $V_{th}$ before the organic EL element OLED is emitted. Note that when the gate-source voltage of the drive transistor $T_d$ becomes the threshold voltage $V_{th}$, the current stops to flow to the drive transistor $T_d$, and thus, the gate-source voltage at the time, that is, $V_{th}$ is applied to the first capacitor element $C_{th}$.

The switching transistor $T_1$ includes a first terminal t31, a second terminal t32, and a third terminal t33. The first terminal t31 is electrically connected to the scan line 25, and the second terminal t32 is electrically connected to the image signal line 26. Further, the third terminal t33 is electrically connected to an electrode of the first capacitor element $C_{th}$. Note that the first terminal t31 corresponds to a gate electrode, the second terminal t32 corresponds to a drain electrode, and the third terminal t33 corresponds to a source electrode.

In the switching transistor $T_1$, current that flows between a drain and a source is adjusted by adjusting a potential applied to the first terminal t31, and more specifically, by adjusting a voltage (gate-source voltage) applied between the first terminal t31 and the third terminal t33. Then, a state (on-state) in which a current can flow between the drain and the source and a state (off-state) in which the current cannot flow are selectively set according to the potential applied to the first terminal t31.

Further, when the switching transistor $T_1$ is turned on and also the image signal voltage is supplied to the image signal line 26, the image signal voltage is applied to the second capacitor element $C_{data}$.

The switching transistor $T_2$ includes a first terminal t41, a second terminal t42, and a third terminal t43. The first terminal t41 is electrically connected to the merge line 24, and the second terminal t42 is electrically connected to the $V_{SS}$ line 21. Further, the third terminal t43 is conductively connected to a wiring that electrically connects the third terminal t33 of the switching transistor $T_1$ and the electrode of the first capacitor element $C_{th}$. Note that the first terminal t41 corresponds to a gate electrode, the second terminal t42 corresponds to a drain electrode, and the third terminal t43 corresponds to a source electrode.

In the switching transistor $T_2$, the current that flows between a drain and a source is adjusted by adjusting a potential applied to the first terminal t41, and more specifically, by adjusting a voltage (gate-source voltage) applied between the first terminal t41 and the third terminal t43. Then, a state (on-state) in which a current can flow between the drain and the source and a state (off-state) in which the current cannot flow between them are selectively set by the potential applied to the first terminal t41.

Further, the switching transistor $T_2$ is turned on when $V_{th}$ is detected (to be described later), and a predetermined potential is applied to an electrode 1*a* of the first capacitor element $C_{th}$.

The first capacitor element $C_{th}$ has a function of holding charge corresponding to the threshold voltage $V_{th}$ of the drive transistor $T_d$ in the period in which the $V_{th}$ is detected (to be described later). Note that one of electrodes of the first capacitor element $C_{th}$ is electrically connected to the third terminal t33 of the switching transistor $T_1$. Further, the other one of the electrodes is electrically connected to the control terminal t11 (gate) of the drive transistor $T_d$.

The second capacitor element $C_{data}$ has a function of holding charge according to the image signal voltage in a write period to be described later. Note that one of electrodes of the second capacitor element $C_{data}$ is conductively connected to a wiring that electrically connects the third terminal t33 of the switching transistor $T_1$ and the electrode of the first capacitor element $C_{th}$. Further, the other electrode of the second capacitor element $C_{data}$ is electrically connected to the $V_{SS}$ line 21.

The $V_{SS}$ line 21 supplies power to the drive transistor $T_d$ and the switching transistor $T_2$. The $T_{th}$ control line 23 supplies a signal for controlling the threshold voltage detecting transistor $T_{th}$. The merge line 24 supplies a signal for controlling the switching transistor $T_2$. The scan line 25 supplies a signal for controlling the switching transistor $T_1$. The image signal line 26 supplies an image signal.

Figure 3:
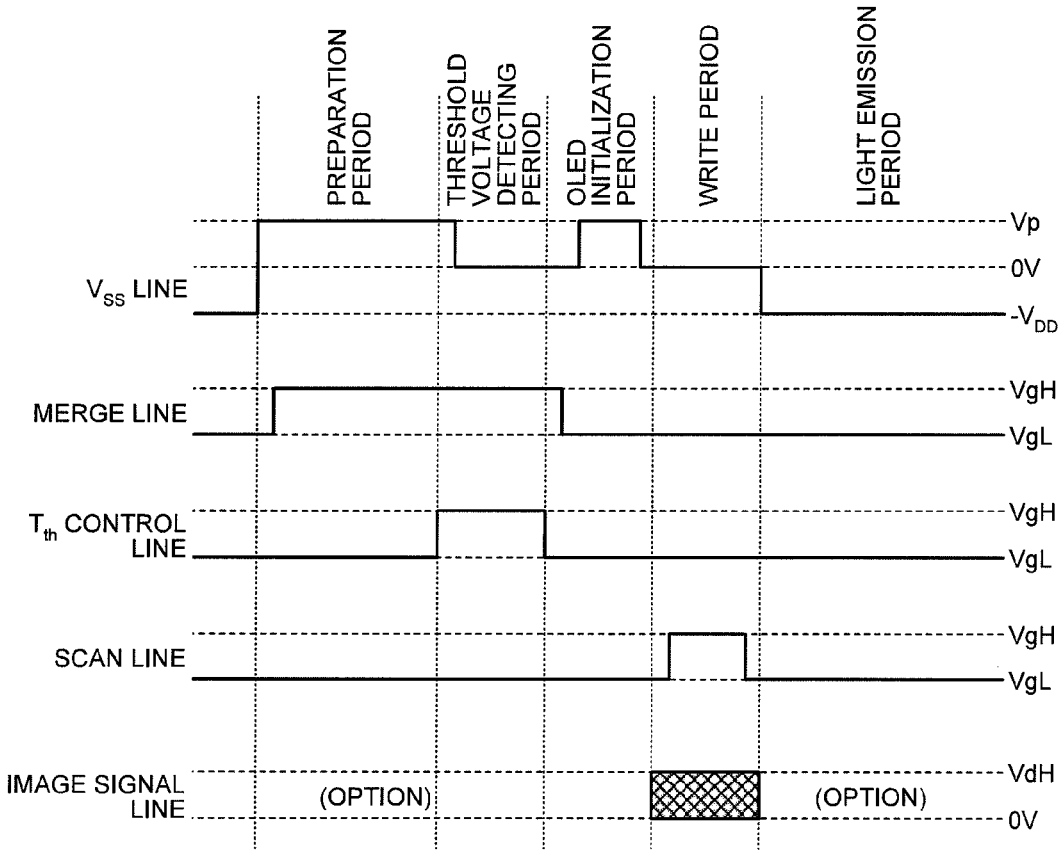
FIG. 3 is a timing chart for explaining a drive method of the pixel circuit.

In the configuration, the pixel circuit operates in four periods of a preparation period, a threshold voltage detecting period, a write period, and a light emission period. FIG. 3 is a timing chart for explaining a drive method of the pixel circuit 10 and illustrates signal waveforms (drive waveforms) when the organic EL element OLED is emitted by a sequential emission system. Here, the sequential emission system is a system for sequentially performing the write control on the image signal voltage of each frame for each pixel circuit and the light emission control on each pixel circuit for each group (for example, for each row, for each column, and the like) of the pixel circuits commonly connected to the same control line or the same power supply cable. Note that, in the embodiment, it is assumed that the write control and the light emission control are performed for each row of the display panel 20 illustrated in FIG. 1. Note that since the GND line 22 which is common to all the pixel circuits is set to a zero potential (0V) at all times, explanation of the GND line 22 is appropriately omitted. Further, an operation of the pixel circuit 10 explained below is realized by the control performed by a drive control unit (the control circuit 31, the power supply control circuit 32, the control line drive circuit 33, and the image signal line drive circuit 34) illustrated in FIG. 1.

In the preparation period, the potential of the merge line 24 is set to $V_gH$, and the charge accumulated in the second capacitor element $C_{data}$ in a previous frame is reset. The $V_{SS}$ line 21 is applied with a predetermined positive potential Vp ($V_{SS}$=Vp=12V). With the operation, a control is performed to turn off the threshold voltage detecting transistor $T_{th}$, to turn off the switching transistor $T_1$, to turn on the drive transistor $T_d$, and to turn on the switching transistor $T_2$. As a result, a current flows through a path along the $V_{SS}$ line 21→the drive transistor $T_d$→the organic EL element capacitor $C_{oled}$, and a charge is accumulated in the organic EL element capacitor $C_{oled}$. Note that the amount of charge accumulated in the organic EL element capacitor $C_{oled}$ is determined depending on a current $I_d$ that flows between the source and the drain of the drive transistor $T_d$. When $I_d$ is large, a larger amount charge can be accumulated, thus, it is sufficient to make $I_d$ large to increase the compensation range.

In the next threshold voltage detecting period, first, the potential of the $T_{th}$ control line 23 is set to $V_gH$, and the charge accumulated in the organic EL element capacitor $C_{oled}$ is added with the charge accumulated in the first capacitor element $C_{th}$. Next, $V_{SS}$=0, that is, the zero potential is applied to the $V_{SS}$ line 21 and a control is performed to turn on the threshold voltage detecting transistor $T_{th}$ so that the gate electrode of the drive transistor $T_d$ is diode connected to the drain electrode thereof. With the operation, the charge accumulated in the first capacitor element $C_{th}$ and the organic EL element capacitor $C_{oled}$ is discharged, and a current flows through a path along the drive transistor $T_d$→the VSS line 21. Then, when the voltage of the gate electrode of the drive transistor $T_d$ to the source electrode thereof reaches the threshold voltage $V_{th}$ corresponding to the drive threshold value of the drive transistor $T_d$, the drive transistor $T_d$ is turned off. In that case, charge corresponding to the threshold voltage $V_{th}$ of the drive transistor $T_d$ is accumulated in the first capacitor element $C_{th}$. When detection of the threshold voltage $V_{th}$ is finished, the potential of the $T_{th}$ control line 23 is set to $V_gL$, and the threshold voltage $V_{th}$ of the drive transistor $T_d$ accumulated in the first capacitor element $C_{th}$ is saved.

In the next OLED initialization period, the $V_{SS}$ line 21 is set to the positive potential Vp and then returned to 0V to initialize the organic EL element OLED.

In the next write period, first, the potential of the merge line 24 is set to $V_gL$ and the potential of the image signal line 26 is set to $V_{data}$ to prepare for a data write. Thereafter, the potential of the scan line 25 is set to $V_gH$ so that $V_{data}$ is accumulated in the second capacitor element $C_{data}$, and a data write is finished by setting the potential of the scan line 25 to $V_gL$. In that case, the potential of the $V_{SS}$ line 21 keeps the zero potential. With the operation, the switching transistor $T_1$ is turned on and the switching transistor $T_2$ is turned off so as to discharge the charge accumulated in the organic EL element capacitor $C_{oled}$. As a result, a current flows through a path along the organic EL element capacitor $C_{oled}$→the threshold voltage detecting transistor $T_{th}$→the first capacitor element $C_{th}$, and a charge is accumulated in the first capacitor element $C_{th}$. That is, the charge accumulated in the organic EL element capacitor $C_{oled}$ moves to the first capacitor element $C_{th}$.

In the next light emission period, a predetermined negative potential (−12V) is applied to the $V_{SS}$ line 21. With the operation, a control is performed to turn on the drive transistor $T_d$, to turn off the threshold voltage detecting transistor $T_{th}$, and to turn off the switching transistor $T_1$. As a result, a current flows through a path along the organic EL element OLED→the drive transistor $T_d$→the $V_{SS}$ line 21, and the organic EL element OLED is emitted. Since a potential is generated to the organic EL element OLED in a forward direction at $V_{SS}$=−12V and GND=0V, a potential is generated to the gate of the drive transistor $T_d$ corresponding to the charge accumulated in the first capacitor element $C_{th}$, and the organic EL element OLED is emitted at the brightness corresponding to the current $I_d$ that flows between the source and the drain of the drive transistor $T_d$. At the time, charge corresponding to $V_{data}$ is accumulated in the second capacitor element $C_{data}$, and charge corresponding to $V_{th}$ is accumulated in the first capacitor element $C_{th}$. Note that the organic EL element OLED is extinguished by eliminating the potential of the organic EL element OLED in the forward direction by setting $V_{SS}$=0V.

When the threshold voltage $V_{th}$ is detected, in an operation in which a current flows through a path along the $V_{SS}$ line 21→the drive transistor $T_d$→the point B illustrated in FIG. 2 and a charge is accumulated in the organic EL element capacitor $C_{oled}$, the threshold voltage $V_{th}$ of the drive transistor $T_d$ is increased as the display panel 20 is used. Accordingly, the amount of charge accumulated in the organic EL element capacitor $C_{oled}$ is reduced.

Figure 4:
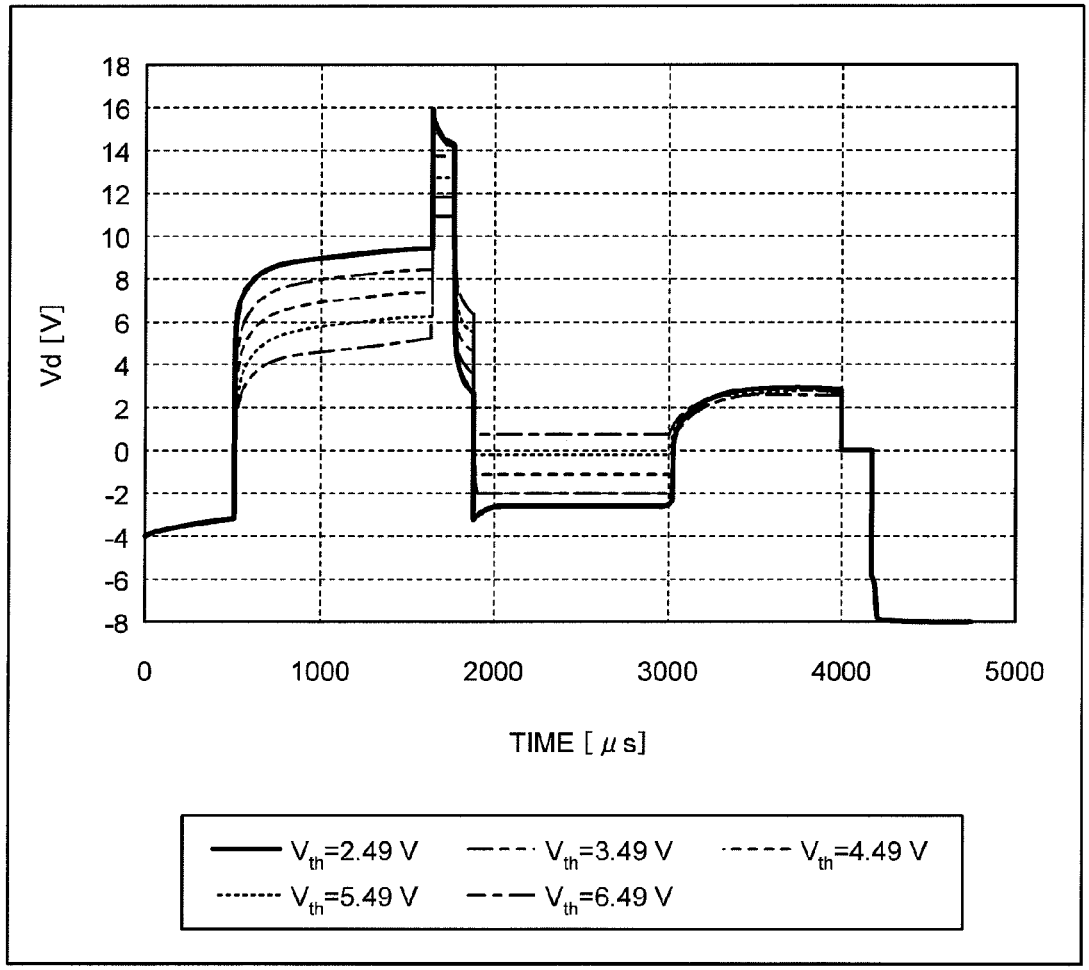
FIG. 4 is a graph illustrating how a potential at a point B in FIG. 2 changes with time.

Here, FIG. 4 is a graph illustrating how a potential at the point B in FIG. 2 changes with time. An X-axis in FIG. 4 represents elapsed time [μsec], and a Y-axis represents potential [V]. FIG. 4 illustrates five lines indicating the threshold voltage $V_{th}$ of the drive transistor $T_d$ set to 2.49V, 3.49V, 4.49V, 5.49V, 6.49V. The graph of FIG. 4 illustrates how the potential of a node at the point B changes as to respective threshold voltages $V_{th}$.

An initial stage in which the threshold voltage $V_{th}$ of the drive transistor $T_d$ does not shift is assumed when the threshold voltage $V_{th}$ of the drive transistor $T_d$ is 2.49V. At the initial potential (2.49V), when $V_{SS}$=Vp=12V and the potential of the merge line 24 is set to $V_gH$, the potential Vc of the point C illustrated in FIG. 2 becomes 12V. Thus, a potential Va of the point A in FIG. 2 also becomes Va≈12V. At the time, if the threshold voltage $V_{th}$ of the drive transistor $T_d$ is 2.49V, $I_d=\alpha\cdot(Va-Vb-2.49)^2$ is reached, and $I_d$ continuously flows until it becomes almost like Vb=Va−2.49V. That is, a potential Vb of the point B shown in FIG. 2 becomes Vb≈9.51V. That is, the initial potential ($V_{th}$ detection start potential) $V_{ini}$ becomes 9.51V.

If the threshold voltage $V_{th}$ of the drive transistor $T_d$ is 4.49V, $I_d=\alpha-(Va-Vb-4.49)^2$ is reached, and $I_d$ continuously flows until it becomes almost like Vb=Va−4.49V. That is, the potential Vb of the point B in FIG. 2 becomes Vb≈7.51V. That is, the initial potential ($V_{th}$ detection start potential) $V_{ini}$ becomes 7.51V. Here, since $V_{ini}$=7.51V>$V_{th}$=4.49 V and thus the initial potential ($V_{th}$ detection start potential) $V_{ini}$ is higher than the threshold voltage $V_{th}$, the threshold voltage $V_{th}$ can be properly detected.

That is, when the threshold voltage $V_{th}$ shifts by stress in lighting, the amount of charge with respect to the organic EL element capacitor $C_{oled}$ changes depending on the threshold voltage $V_{th}$ of the drive transistor $T_d$.

Then, when the threshold voltage $V_{th}$ shifts by the stress at the time of the lighting and the threshold voltage $V_{th}$ of the drive transistor $T_d$ becomes 6.1V, $I_d=\alpha\cdot(Va-Vb-6.1)^2$ is reached, and $I_d$ continuously flows until it becomes almost like Vb=Va−6.1V. That is, the potential Vb of the point B in FIG. 2 becomes Vb≈5.9V. That is, the initial potential ($V_{th}$ detection start potential) $V_{ini}$ becomes 5.9V. In that case, since $V_{ini}$=5.9V<$V_{th}$=6.1V and thus the initial potential ($V_{th}$ detection start potential) $V_{ini}$ is lower than the threshold voltage $V_{th}$, the threshold voltage $V_{th}$ may not be properly detected.

Figure 5:
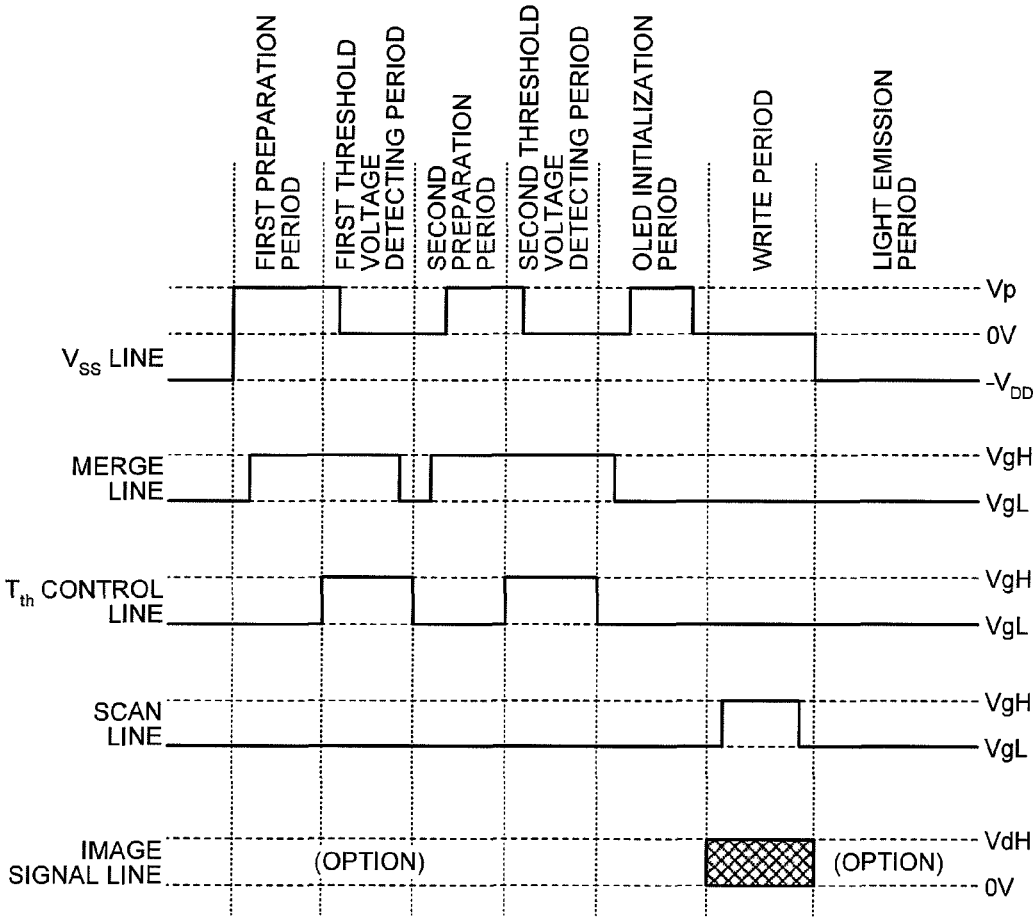
FIG. 5 is a timing chart for explaining a drive method of the pixel circuit.

Here, a characteristic operation of the pixel circuit of the embodiment will be explained. FIG. 5 is a timing chart for explaining a drive method of the pixel circuit 10. The characteristic operation of the pixel circuit 10 illustrated in FIG. 5 is different from the operation illustrated in FIG. 3 in that the preparation period and the threshold voltage detecting period are repeated twice. More specifically, first charge is charged to the organic EL element capacitor $C_{oled}$ by controlling the threshold voltage detecting transistor $T_{th}$. Then, the first charge is accumulated in the first capacitor element $C_{th}$ by detecting the threshold voltage $V_{th}$. Further, second charge is charged to the organic EL element capacitor $C_{oled}$ again by controlling the threshold voltage detecting transistor $T_{th}$. Then, the second charge is further accumulated in the first capacitor element $C_{th}$ in addition to the first charge by detecting the threshold voltage $V_{th}$.

In the first threshold voltage detecting period illustrated in FIG. 5, the first charge is charged for the first time to the organic EL element capacitor $C_{oled}$ in such a manner that the potential of the merge line 24 is set to $V_gH$ to reset the charge accumulated in the second capacitor element $C_{data}$, and the predetermined positive potential Vp ($V_{SS}$=Vp=12V) is applied to the $V_{SS}$ line 21. Note that the threshold voltage $V_{th}$ is detected as described above.

In the subsequent second threshold voltage detecting period, it is performed in such a manner that the potential of the merge line 24 is set to $V_gH$ to reset the charge accumulated in the second capacitor element $C_{data}$, and the predetermined positive potential Vp ($V_{SS}$=Vp=12V) is applied to the $V_{SS}$ line 21. Here, since the first charge corresponding to the threshold voltage $V_{th}$ of the drive transistor $T_d$ is already accumulated in the first capacitor element $C_{th}$, the potential Va of the point A illustrated in FIG. 2 becomes a potential obtained by adding the first charge and the second charge, and Va≈Vp+$V_{th}$=12+$V_{th}$ is reached. Accordingly, $I_d=\alpha\cdot(Va-Vb-V_{th})^2=\alpha\cdot(Vp-Vb)^2$ is reached and Vb is charged until Vp=Vb is reached regardless of $V_{th}$.

Figure 6:
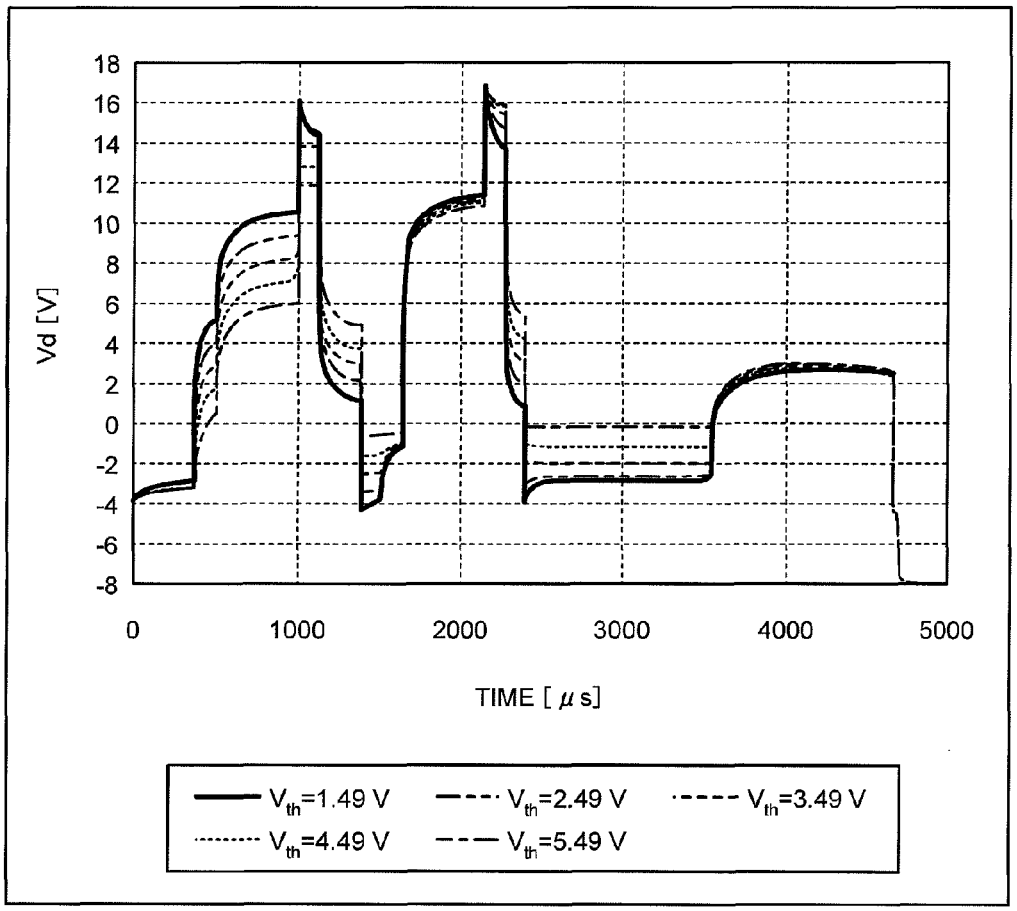
FIG. 6 is a graph illustrating how the potential at the point B in FIG. 2 changes with time.

Here, FIG. 6 is a graph illustrating how the potential at the point B illustrated in FIG. 2 changes with time. As illustrated in FIG. 6, Vp≈11 V can be secured regardless of the amount of shift of the threshold voltage $V_{th}$.

According to the embodiment, the first charge is accumulated in the first capacitor element $C_{th}$ and the potential of the control terminal t11 of the drive transistor $T_d$ is increased so that a current can be caused to flow easily from the $V_{SS}$ line 21 to the organic EL element capacitor $C_{oled}$ via the drive transistor $T_d$. As a result, the second charge can be eventually accumulated in the organic EL element capacitor $C_{oled}$ in a short time.

That is, as compared with the time in which the first charge reaches the organic EL element capacitor $C_{oled}$ from the $V_{SS}$ line 21 via the drive transistor $T_d$, the time, in which the second charge reaches the organic EL element capacitor $C_{oled}$ from the $V_{SS}$ line 21 via the drive transistor $T_d$, is short. This is because, when the second charge reaches the organic EL element capacitor $C_{oled}$, the first charge is accumulated in the first capacitor element $C_{th}$, therefore, the potential of the control terminal t11 of the drive transistor $T_d$ is increased and thus the state is set such that a current can easily flow to the drive transistor $T_d$. Accordingly, the second charge can be accumulated in the organic EL element capacitor $C_{oled}$ in a short time.

Further, the first charge is set smaller than the second charge. This is because, as compared with the case in which the amount of the first charge is made larger than the amount of the second charge and charge larger than the threshold voltage of the drive transistor $T_d$ is accumulated in the first capacitor element $C_{th}$, the case, in which the amount of the second charge is made larger than the amount of the first charge and charge larger than the threshold voltage of the drive transistor $T_d$ is accumulated in the first capacitor element $C_{th}$, can cause charge larger than the threshold voltage of the drive transistor $T_d$ to be accumulated in a short time. That is, if charge is accumulated in the first capacitor element $C_{th}$ even in a small amount, the potential of the control terminal t11 of the drive transistor $T_d$ can be increased, and thus the current can be caused to flow easily to the drive transistor $T_d$. Accordingly, first, in the state in which it is difficult for the current of the drive transistor $T_d$ to flow, the first charge, which is a small amount of charge, is accumulated in the first capacitor element $C_{th}$, and thereafter the second charge whose amount is larger than that of the first charge is supplied so that a charge equal to or larger than the threshold voltage is accumulated.

As described above, according to the embodiment, when the operation, in which the drive control unit detects the threshold voltage $V_{th}$ of the drive transistor $T_d$ and holds the threshold voltage $V_{th}$ in the first capacitor element $C_{th}$ by supplying charge from the $V_{SS}$ line 21 to the organic EL element capacitor $C_{oled}$ by controlling the threshold voltage detecting transistor $T_{th}$, is repeated for plural times (for example, twice), the charge of the threshold voltage $V_{th}$ of the drive transistor $T_d$ for the plural times is accumulated in the first capacitor element $C_{th}$. Accordingly, since the initial potential ($V_{th}$ detection start potential) which is necessary to compensate the threshold voltage $V_{th}$ can be sufficiently applied in a short time, a voltage equal to or larger than the threshold voltage $V_{th}$ can be stably applied to the driver element for a long period.

Next, a second embodiment of the present invention will be explained based on FIGS. 7 and 8. Note that the same portions as those of the first embodiment described above are denoted by the same reference numerals, and explanation thereof is omitted.

Figure 7:
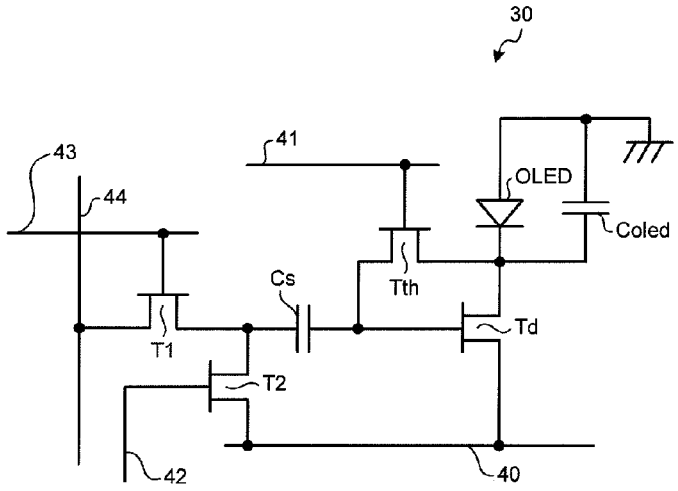
FIG. 7 is a view illustrating an example of a configuration of the pixel circuit (one pixel) according to a second embodiment of the present invention.

FIG. 7 is a view illustrating an example of a configuration of a pixel circuit (one pixel) 30 according to the second embodiment. As illustrated in the figure, the pixel circuit 30 is configured to include an organic EL element OLED as a light-emitting element, an organic EL element capacitor $C_{oled}$ as a light-emitting element capacitor, a drive transistor $T_d$ as a driver element, a threshold voltage detecting transistor $T_{th}$ as a threshold voltage detecting element, a capacitor element $C_s$, a switching transistor $T_1$, and a switching transistor $T_2$.

A power supply line 40 as a charge supply line supplies power to the drive transistor $T_d$ and the switching transistor $T_2$. A $T_{th}$ control line 41 supplies a signal for controlling the threshold voltage detecting transistor $T_{th}$. A merge line 42 supplies a signal for controlling the switching transistor $T_2$. A scan line 43 supplies a signal for controlling the switching transistor $T_1$. An image signal line 44 supplies an image signal.

Figure 8:
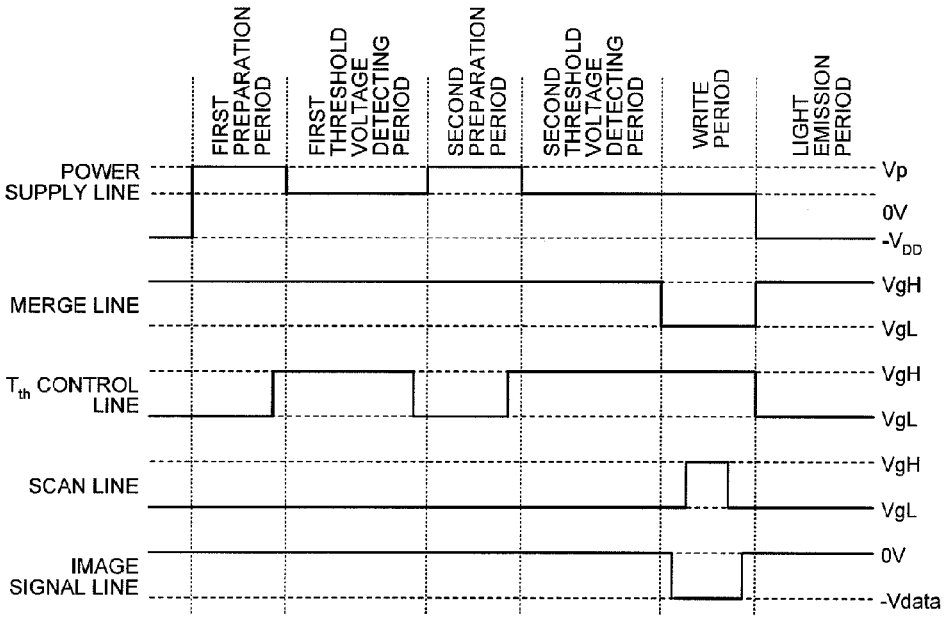
FIG. 8 is a timing chart for explaining a drive method of the pixel circuit.

FIG. 8 is a timing chart for explaining a drive method of the pixel circuit 30. As illustrated in FIG. 8, the pixel circuit 30 operates in six periods of a first preparation period, a first threshold voltage detecting period, a second preparation period, a second threshold voltage detecting period, a write period, and a light emission period. That is, in the first preparation period, a predetermined positive potential (Vp, Vp>0) is applied to the power supply line 40, and a control is performed to turn off the threshold voltage detecting transistor $T_{th}$, to turn off the switching transistor $T_1$, to turn on the drive transistor $T_d$, and to turn on the switching transistor $T_2$. As a result, a current flows through a path along the power supply line 40→the drive transistor $T_d$→the organic EL element capacitor $C_{oled}$, and a first charge is accumulated in the organic EL element capacitor $C_{oled}$.

In the next first threshold voltage detecting period, the zero potential is applied to the power supply line 40, a control is performed to turn on the threshold voltage detecting transistor $T_{th}$ ($T_{th}$ control line 41=$V_g$H), and a gate electrode a drain electrode of the drive transistor $T_d$ is connected with each other. With the operation, the charge accumulated in the capacitor element $C_s$ and the organic EL element capacitor $C_{oled}$ is discharged, and current flows through a path along the drive transistor $T_d$→the power supply line 40. Then, when the voltage of the gate electrode of the drive transistor $T_d$ with respect to a source electrode thereof reaches a threshold voltage $V_{th}$ corresponding to the drive threshold value of the drive transistor $T_d$, the drive transistor $T_d$ is turned off. In that case, the first charge corresponding to the threshold voltage $V_{th}$ of the drive transistor $T_d$ is accumulated in the capacitor element $C_s$.

Also in the subsequent second preparation period, the predetermined positive potential (Vp, Vp>0) is applied to the power supply line 40, and a control is performed to turn off the threshold voltage detecting transistor $T_{th}$, to turn off the switching transistor $T_1$, to turn on the drive transistor $T_d$, and to turn on the switching transistor $T_2$. As a result, current flows through a path along the power supply line 40→the drive transistor $T_d$→the organic EL element capacitor $C_{oled}$, and second charge is accumulated in the organic EL element capacitor $C_{oled}$. At the time, since the first charge corresponding to the threshold voltage $V_{th}$ of the drive transistor $T_d$ is accumulated in the capacitor element $C_s$, current can be caused to flow easily to the transistor $T_d$ so as to turn on the transistor $T_d$ deep, whereby the organic EL element capacitor $C_{oled}$ is sufficiently charged.

Also in the next second threshold voltage detecting period, the zero potential is applied to the power supply line 40, a control is performed to turn on the threshold voltage detecting transistor $T_{th}$, and the gate electrode and the drain electrode of the drive transistor $T_d$ are connected with each other. In that case, since detection of the threshold voltage $V_{th}$ of the drive transistor $T_d$ is started from a potential sufficiently higher than the threshold voltage $V_{th}$, a compensation range is widened.

In the next write period, the potential of the power supply line 40 keeps the zero potential, the switching transistor $T_1$ is turned on, the switching transistor $T_2$ is turned off, and the second charge accumulated in the organic EL element capacitor $C_{oled}$ is discharged. As a result, a current flows through a path along the organic EL element capacitor $C_{oled}$→the threshold voltage detecting transistor $T_{th}$→the capacitor element $C_s$, and the second charge is accumulated in the capacitor element $C_s$ in addition to the first charge. That is, the first charge accumulated in the organic EL element capacitor $C_{oled}$ moves to the capacitor element $C_s$. Note that, in FIG. 8, although the potential of the image signal line 44 is set to 0V at the time other than the write time, the potential may be set to any potential other than 0V.

In the next light emission period, a predetermined negative potential ($-V_{DD}$, $V_{DD}$>0) is applied to the power supply line 40, and a control is performed to turn on the drive transistor $T_d$, to turn off the threshold voltage detecting transistor $T_{th}$, and to turn off the switching transistor $T_1$. As a result, a current flows through a path along the organic EL element OLED→the drive transistor $T_d$→the power supply line 40, and the organic EL element OLED emits light.

Next, a third embodiment of the invention will be explained based on FIG. 9 and FIG. 10. Note that the same portions as those of the first embodiment described above are denoted by the same reference numerals and explanation thereof is omitted.

Figure 9:
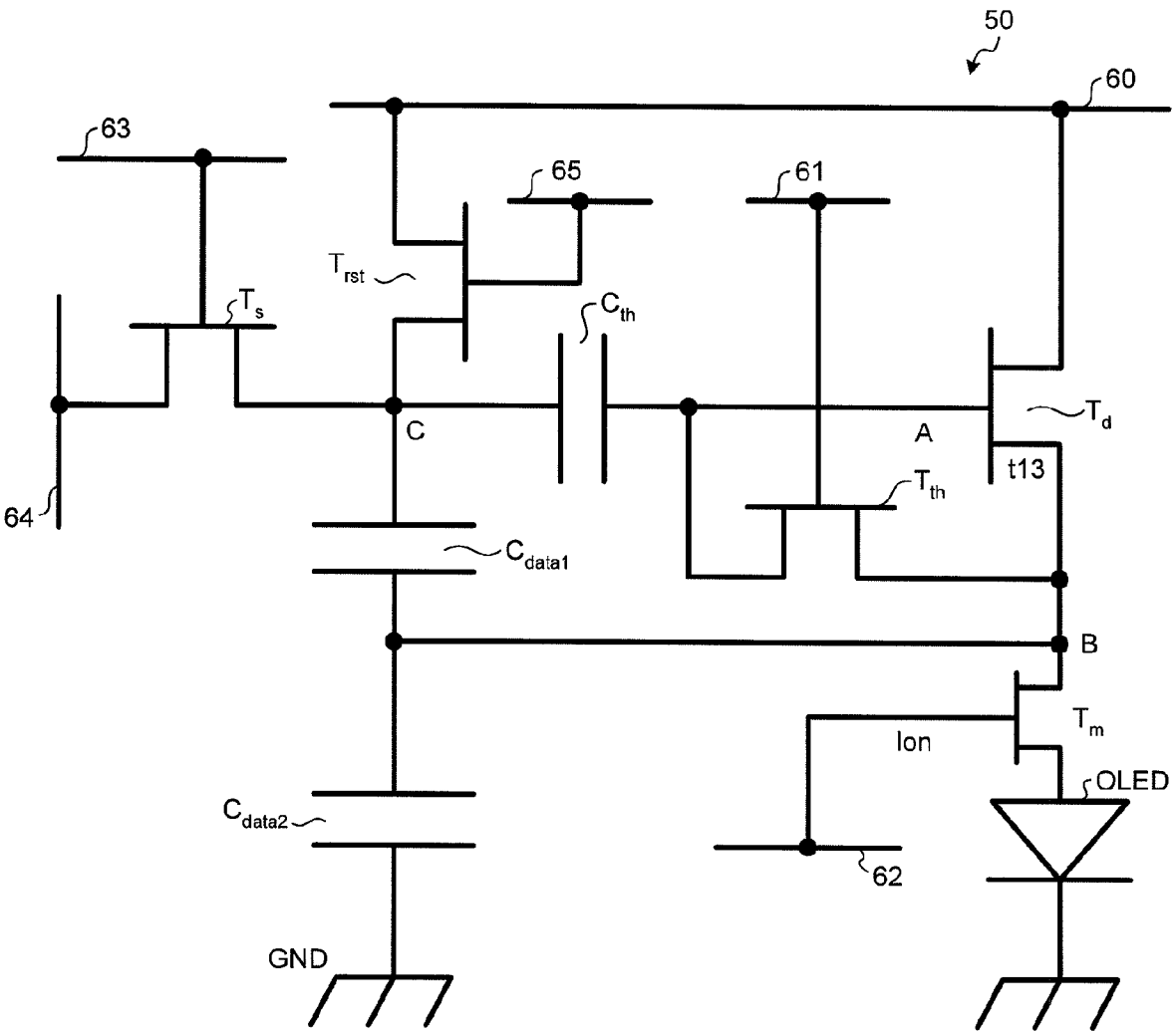
FIG. 9 is a view illustrating an example of a configuration of the pixel circuit (one pixel) according to a third embodiment of the present invention.

FIG. 9 is a view illustrating an example of a configuration of a pixel circuit (one pixel) 50 according to the third embodiment. As illustrated in the view, the pixel circuit 50 is configured to include an organic EL element OLED as a light-emitting element, an organic EL element capacitor $C_{oled}$ as a light-emitting element capacitor, a drive transistor $T_d$ as a driver element, a threshold voltage detecting transistor $T_{th}$ as a threshold voltage detecting element, a capacitor element $C_{th}$, a reset transistor $T_{rst}$, a switching transistor $T_s$, a memory transistor $T_m$, a first data capacitor element $C_{data1}$, and a second data capacitor element $C_{data2}$.

A power supply line 60 as a charge supply line supplies power to the drive transistor $T_d$ and the reset transistor $T_{rst}$. A $T_{th}$ control line 61 supplies signals for controlling the threshold voltage detecting transistor $T_{th}$. A merge line 62 supplies a signal for controlling the memory transistor $T_m$. A scan line 63 supplies a signal for controlling the switching transistor $T_s$. An image signal line 64 supplies image signals. A $T_{rst}$ control line 65 supplies signals for controlling the reset transistor $T_{rst}$.

Figure 10:
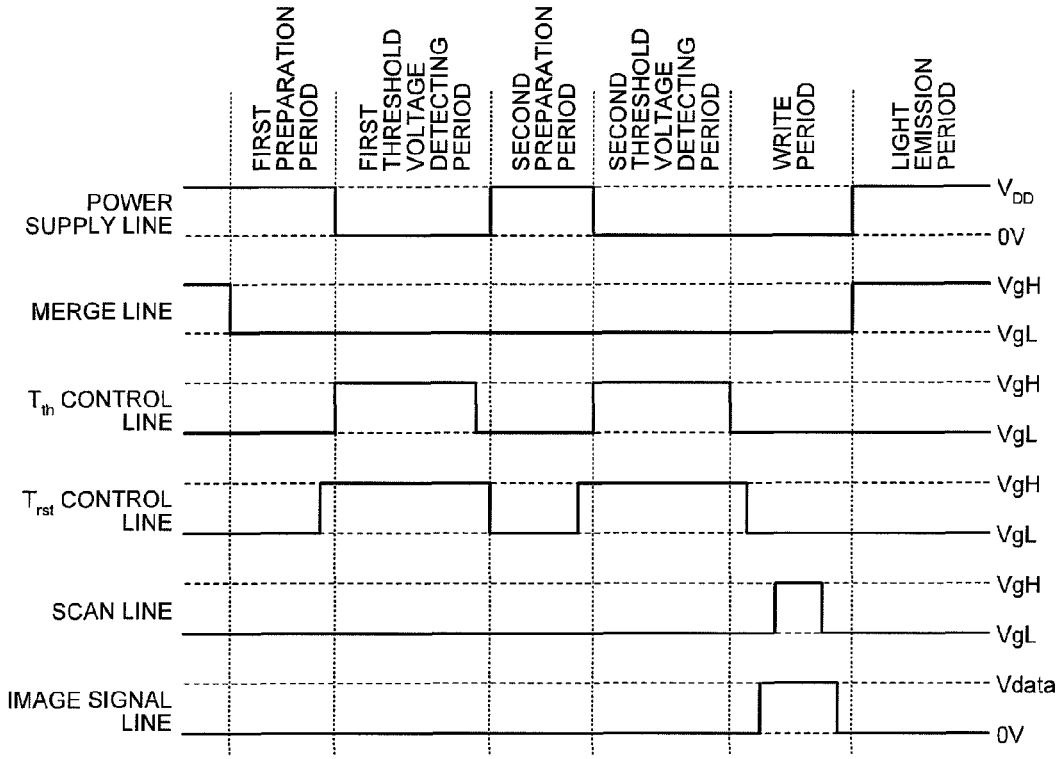
FIG. 10 is a timing chart for explaining a drive method of the pixel circuit.

FIG. 10 is a timing chart for explaining a drive method of the pixel circuit 50. As illustrated in FIG. 10, the pixel circuit 50 operates in six periods of a first preparation period, a first threshold voltage detecting period, a second preparation period, a second threshold voltage detecting period, a write period, and a light emission period. That is, in the first preparation period, a predetermined positive potential ($V_{DD}$) is applied to the power supply line 60, the merge line 62 is set to $V_gL$, and a control is performed to turn off the threshold voltage detecting transistor $T_{th}$, to turn off the reset transistor $T_{rst}$, and to turn on the drive transistor $T_d$. As a result, a current flows through a path along the power supply line 60→the drive transistor $T_d$→a point B, and charge is accumulated in the first data capacitor element $C_{data1}$ and the second data capacitor element $C_{data2}$.

In the next first threshold voltage detecting period, the zero potential is applied to the power supply line 60, a control is performed to turn on the threshold voltage detecting transistor $T_{th}$ and the reset transistor $T_{rst}$ ($T_{th}$ control line 61=$V_gH$, $T_{rst}$ control line 65=$V_gH$) and a gate electrode and a drain electrode of the drive transistor $T_d$ are connected with each other. With the operation, the charge accumulated in the capacitor element $C_{th}$, the first data capacitor element $C_{data1}$, and the second data capacitor element $C_{data2}$ is discharged, and current flows through a path along the drive transistor $T_d$→the power supply line 60. Then, when the voltage of the gate electrode of the drive transistor $T_d$ with respect to a source electrode thereof reaches a threshold voltage $V_{th}$ corresponding to the drive threshold value of the drive transistor $T_d$, the drive transistor $T_d$ is turned off. In that case, first charge corresponding to the threshold voltage $V_{th}$ of the drive transistor $T_d$ is accumulated in the capacitor element $C_{th}$.

Also in the subsequent second preparation period, the predetermined positive potential ($V_{DD}$) is applied to the power supply line 60, and a control is performed to turn off the threshold voltage detecting transistor $T_{th}$, to turn off the reset transistor $T_{rst}$, and to turn on the drive transistor $T_d$. As a result, a current flows through a path along the power supply line 60→the drive transistor $T_d$→the point B, and charge is accumulated in the first data capacitor element $C_{data1}$ and the second data capacitor element $C_{data2}$. At the time, since the first charge corresponding to the threshold voltage $V_{th}$ of the drive transistor $T_d$ is accumulated in the capacitor element $C_{th}$, a current can be caused to flow easily to the transistor $T_d$ so as to turn on the transistor $T_d$ deep, whereby the first data capacitor element $C_{data1}$ and the second data capacitor element $C_{data2}$ are sufficiently charged.

Also in the next second threshold voltage detecting period, the zero potential is applied to the power supply line 60, a control is performed to turn on the threshold voltage detecting transistor $T_{th}$ and the reset transistor $T_{rst}$, and the gate electrode and the drain electrode of the drive transistor $T_d$ are connected with each other. In that case, since detection of the threshold voltage $V_{th}$ of the drive transistor $T_d$ is started from a potential sufficiently higher than $T_{th}$ control line 61=$V_gH$, a compensation range is widened.

In the next write period, the potential of the power supply line 60 keeps the zero potential, the switching transistor $T_s$ is turned on, and the charge accumulated in the first data capacitor element $C_{data1}$ and the second data capacitor element $C_{data2}$ is discharged. As a result, a current flows through a path along the first data capacitor element $C_{data1}$, the second data capacitor element $C_{data2}$→the threshold voltage detecting transistor $T_{th}$→the capacitor element $C_{th}$, and the second charge is accumulated in the capacitor element $C_{th}$ in addition to the first charge. That is, the charge accumulated in the first data capacitor element $C_{data1}$, the second data capacitor element $C_{data2}$ moves to the capacitor element $C_{th}$. Note that, in FIG. 10, although the potential of the image signal line 44 is set to 0V at the time other than a write time, the potential may be set to any potential other than 0V.

In the next emission period, the predetermined positive potential ($V_{DD}$) is applied to the power supply line 60, and a control is performed to turn on the drive transistor $T_d$ and to turn off the threshold voltage detecting transistor $T_{th}$ and the reset transistor $T_{rst}$. As a result, current flows through a path along the power supply line 60→the drive transistor $T_d$→memory transistor $T_m$→the organic EL element OLED, and the organic EL element OLED is emitted.

Although the embodiments according to the present invention are explained above, the present invention is not limited to the embodiments and various modifications, replacements, additions, and the like are possible within a scope which does not depart from the gist of the present invention.

The invention claimed is:

1. An image display device comprising:

a display panel including a pixel circuit, the pixel circuit including a light-emitting element, a driver element, and a capacitor element, the light-emitting element emitting light when a voltage is applied thereto in a forward direction and accumulating electrical charge when a voltage is applied thereto in a reverse direction, the driver element causing the light-emitting element to emit the light when a voltage equal to or greater than a threshold voltage is applied thereto, the capacitor element accumulating electrical charge for adjusting current flowing in the driver element;

a charge supply line for supplying electrical charge to the light-emitting element of the pixel circuit; and a drive control unit which supplies a second electrical charge from the charge supply line to the light-emitting element after a first electrical charge accumulated in the light-emitting element is supplied to the capacitor element, further supplies the second electrical charge to the capacitor element and accumulates the first electrical charge and the second electrical charge in the capacitor element, and applies a voltage greater than or equal to the threshold voltage to a control terminal of the driver element, within one frame after the light-emitting element emits light until the light-emitting element emits light next, wherein an amount of the second electrical charge is larger than an amount of the first electrical charge.

2. The image display device according to claim 1, wherein the second electrical charge is supplied to the light-emitting element via the driver element.

3. The image display device according to claim 1, wherein the capacitor element in which the first electrical charge is accumulated increases a gate potential of the driver element, and the second electrical charge is supplied to the light-emitting element via the driver element in a state in which current is caused to flow to the driver element.

4. The image display device according to claim 1, wherein a threshold voltage detecting element is connected between the light-emitting element and the capacitor element, and the first electrical charge or the second electrical charge is supplied from the light-emitting element to the capacitor element via the threshold voltage detecting element.

5. The image display device according to claim 1, wherein the one frame includes a first preparation period, a first threshold voltage detecting period, a second preparation period, a second threshold voltage detecting period, a write period, and a light emission period.

* * * * *